US009161600B1

(12) United States Patent
Liu et al.

(10) Patent No.: US 9,161,600 B1
(45) Date of Patent: Oct. 20, 2015

(54) RETRACTABLE LUGGAGE HANDLE ASSEMBLY

(71) Applicant: MERRIMACK RIVER PRECISION INDUSTRIAL CORPORATION, Taipei (TW)

(72) Inventors: Wen-Hua Liu, Taipei (TW); Sheng Yeh, Taipei (TW)

(73) Assignee: Merrimack River Precision Industrial Corporation, Taipei (TW)

( * ) Notice: Subject to any disclaimer, the term of this patent is extended or adjusted under 35 U.S.C. 154(b) by 0 days.

(21) Appl. No.: 14/451,511

(22) Filed: Aug. 5, 2014

(51) Int. Cl.
*A45C 13/26* (2006.01)

(52) U.S. Cl.
CPC ..... *A45C 13/262* (2013.01); *A45C 2013/267* (2013.01)

(58) Field of Classification Search
CPC ..... Y10T 16/451; A45C 13/26; A45C 13/28; A45C 13/262; A45C 2013/267; B62B 5/06; B62B 5/067; B62B 5/065
See application file for complete search history.

(56) References Cited

U.S. PATENT DOCUMENTS 3,513,952 A * 5/1970 Warner, Jr. ..... A45C 13/262 16/113.1
5,522,615 A * 6/1996 Kazmark, Jr. ..... A45C 13/262 190/18 A
5,613,273 A * 3/1997 Tsai ..... A45C 13/262 16/113.1
5,639,109 A * 6/1997 Liang ..... A45C 13/262 16/113.1
5,692,266 A * 12/1997 Tsai ..... A45C 13/262 16/113.1
5,781,965 A * 7/1998 Lu ..... A45C 13/262 16/113.1
5,803,214 A * 9/1998 Wang ..... A45C 13/262 16/405
5,884,362 A * 3/1999 Tsai ..... A45C 13/262 16/113.1
6,026,543 A * 2/2000 Chen ..... A45C 13/262 16/113.1
6,044,522 A * 4/2000 Liu ..... A45C 13/262 16/113.1
6,128,806 A * 10/2000 Shou-Mao ..... A45C 13/262 16/113.1
6,131,917 A * 10/2000 Walsh ..... B62B 1/08 280/43.1
6,226,834 B1 * 5/2001 Lu ..... A45C 13/262 16/113.1
6,357,080 B1 * 3/2002 Tsai ..... A45C 13/262 16/113.1
6,470,529 B1 * 10/2002 Chang ..... A45C 13/262 16/113.1
7,549,520 B1 * 6/2009 Chen ..... A45C 13/262 16/113.1
2002/0032950 A1 * 3/2002 Kuo ..... A45C 13/262 16/113.1
2002/0095745 A1 * 7/2002 Wang ..... A45C 13/262 16/405
2004/0177475 A1 * 9/2004 Lau ..... A45C 13/262 16/114.1
2004/0178036 A1 * 9/2004 Kuo ..... A45C 13/262 190/115
2005/0067245 A1 * 3/2005 Tsai ..... A45C 13/262 190/115
2006/0213029 A1 * 9/2006 Lu ..... A45C 13/262 16/113.1
2006/0225981 A1 * 10/2006 Lin ..... A45C 13/262 190/115
2007/0007737 A1 * 1/2007 Dayton ..... B62B 1/125 280/37
2008/0078053 A1 * 4/2008 Lu ..... A45C 13/262 16/113.1
2009/0026031 A1 * 1/2009 Wilczak ..... A45C 13/262 190/115

* cited by examiner

*Primary Examiner* — Chuck Mah
(74) *Attorney, Agent, or Firm* — Rosenber, Klein & Lee

(57) ABSTRACT

A retractable luggage handle assembly includes a base unit consisting of two outer sleeves, a retractable handle consisting of two retractable bars, two actuation members and a grip and mounted in the base unit and movable relative to the base unit between an extended position and a received position, and a pullback and buffer unit consisting of two rails, two sliding blocks, two movable member sets, two spring-loaded guide members, two buffers, and two locating caps and adapted for pulling the retractable bars back to the inside of the outer sleeves of the base unit and moving the buffers to buffer the movement of the sliding blocks when the user operates a control button at the grip to receive the retractable handle.

7 Claims, 10 Drawing Sheets

RETRACTABLE LUGGAGE HANDLE ASSEMBLY

BACKGROUND OF THE INVENTION

1. Field of the Invention

The present invention relates to retractable handle technology and more particularly, to a retractable luggage handle assembly, which uses a pullback and buffer unit to automatically pull the retractable handle from the extended position back to the received position and to buffer the downward movement of the sliding blocks at the bottom side of the retractable handle after the user unlocked the retractable handle, preventing the collapsing retractable handle from making noise.

2. Description of the Related Art

With the rapid development of the society and continuous increasing of the national income, people gradually change their lifestyles, and due to the popularity and convenience of transport vehicles, people frequently take transportation vehicles for business travel, or for leisure and entertainment. When traveling, people usually will use a luggage to take their clothes, daily necessities, documents, and other personal items. To facilitate carrying, commercial luggage are commonly equipped with a retractable handle that can be extended out for enabling the user to drag the luggage, or received for enabling the user to store or deliver the luggage.

Conventional retractable luggage handle generally comprise a control button at the top side thereof for pressing by the user to unlock engagement members so that the user can pull the retractable handle from the received position to the extended position, or push the retractable handle from the extended position to the received position. However, if the retractable handle is not positively locked in the received position during delivery of the luggage, the retractable handle can be easily damaged. Further, when the user pushes the retractable handle from the extended position back to the received position, a noise can be made, resulting in user's psychological and emotional discomfort and shortening the lifespan of the luggage.

SUMMARY OF THE INVENTION

The present invention has been accomplished under the circumstances in view. It is therefore the main object of the present invention to provide a retractable luggage handle assembly, which uses a pullback and buffer unit to automatically pull the component parts of the retractable handle back to the received position and to buffer the movement of the component parts of the retractable handle when the user unlocks the retractable handle from the extended position, preventing making noise and prolonging the lifespan of the luggage.

To achieve this and other objects of the present invention, a retractable luggage handle assembly in accordance with the present invention comprises a base unit comprising two outer sleeves arranged in parallel, a retractable handle consisting of two retractable bars, two actuation members and a grip with a control button and mounted in the base unit and controllable to move between an extended position and a received position, and a pullback and buffer unit consisting of two rails, two sliding blocks, two movable member sets, two spring-loaded guide members and two hydraulic cylinder-based buffers adapted for pulling the retractable bars back to the inside of the outer sleeves of the base unit and buffering the movement of the sliding blocks when a person operates the control button and moves the grip to receive the retractable handle from the extended position to the received position

DETAILED DESCRIPTION OF THE PREFERRED EMBODIMENT

Figure 1:
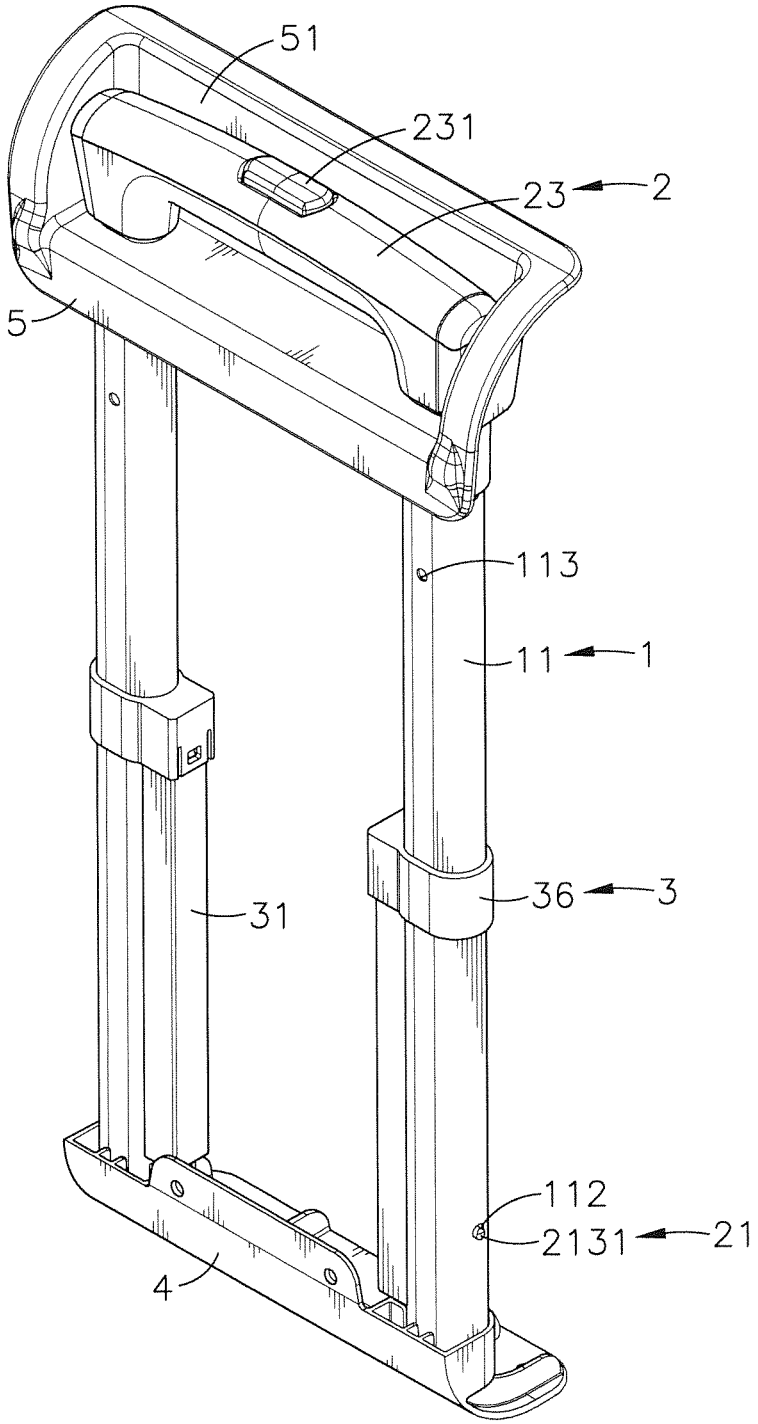
FIG. 1 is an oblique top elevational view of a retractable luggage handle assembly in accordance with the present invention.
Figure 2:
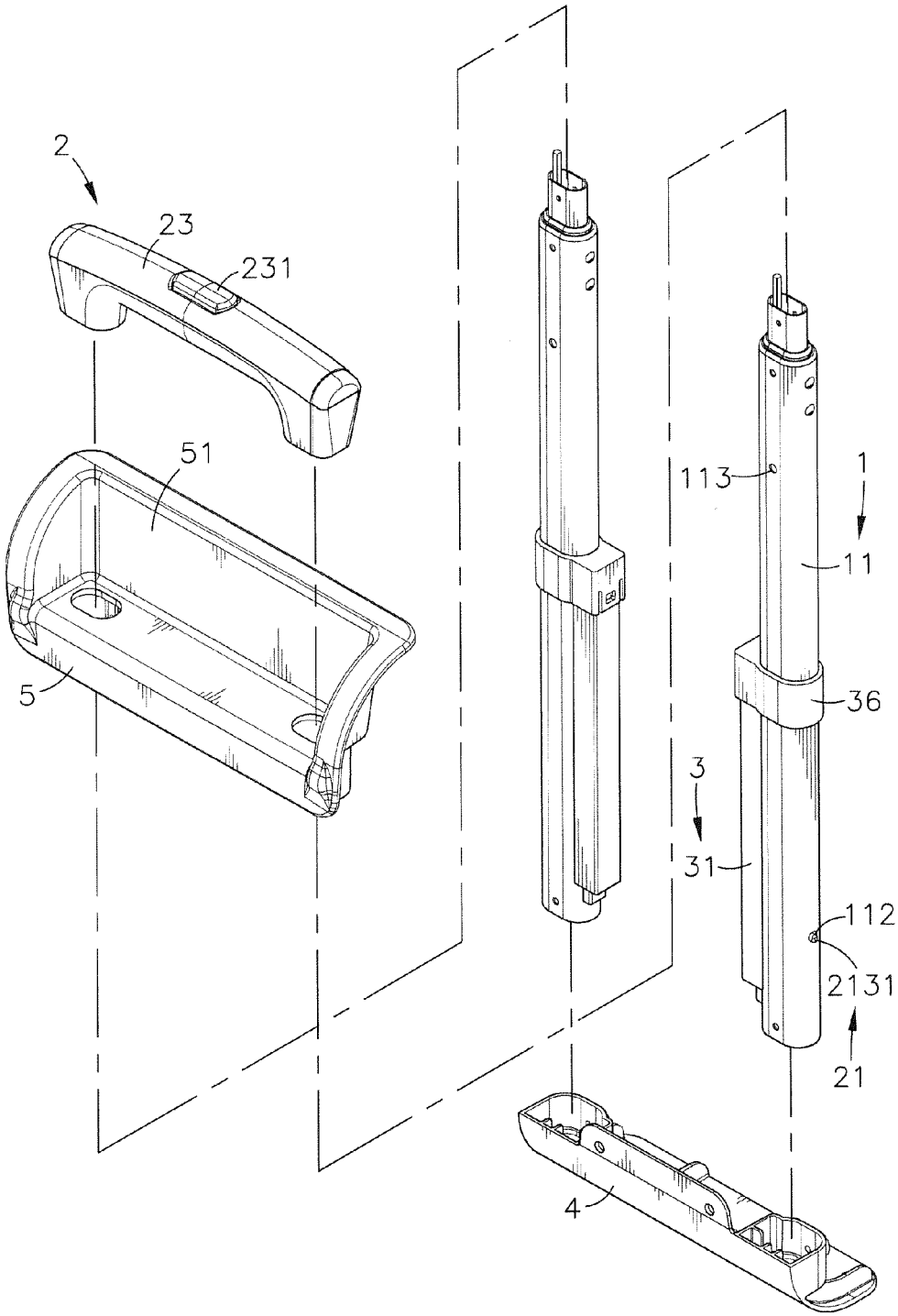
FIG. 2 is an exploded view of the retractable luggage handle assembly in accordance with the present invention (the top mounting frame and the bottom mounting frame excluded).
Figure 3:
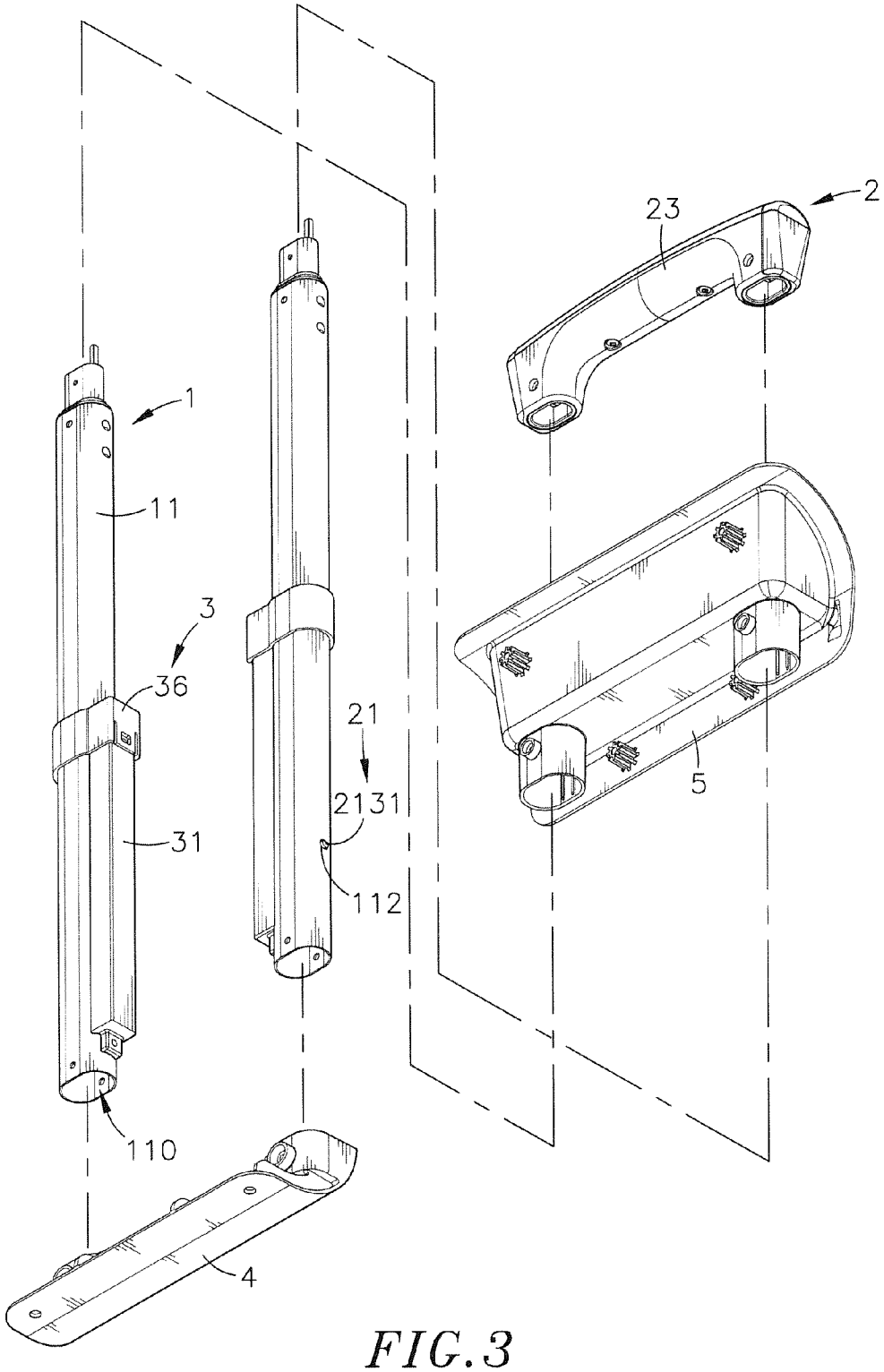
FIG. 3 corresponds to FIG. 2 when viewed from another angle.
Figure 4:
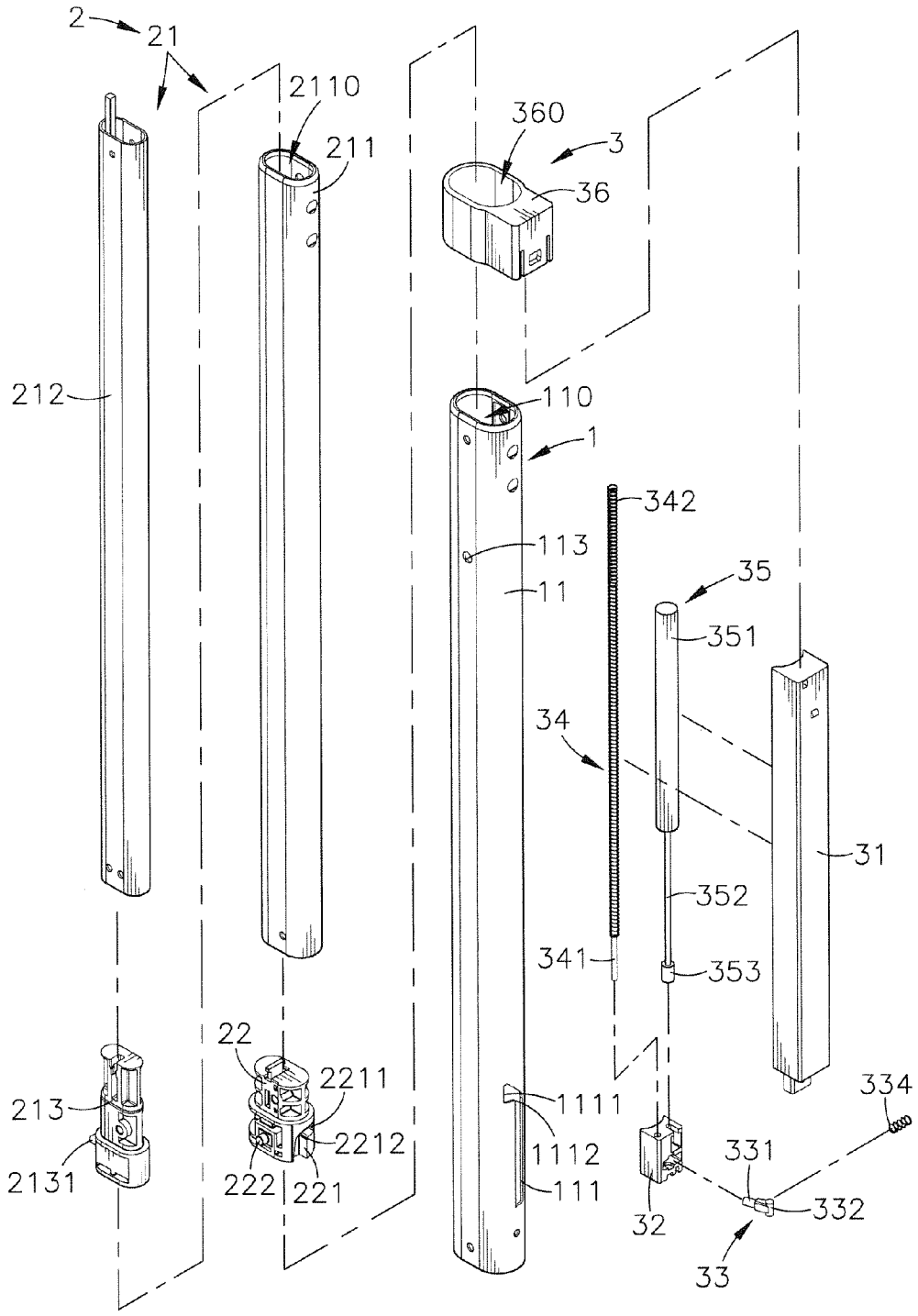
FIG. 4 is an exploded view of a part of the retractable luggage handle assembly in accordance with the present invention.
Figure 5:
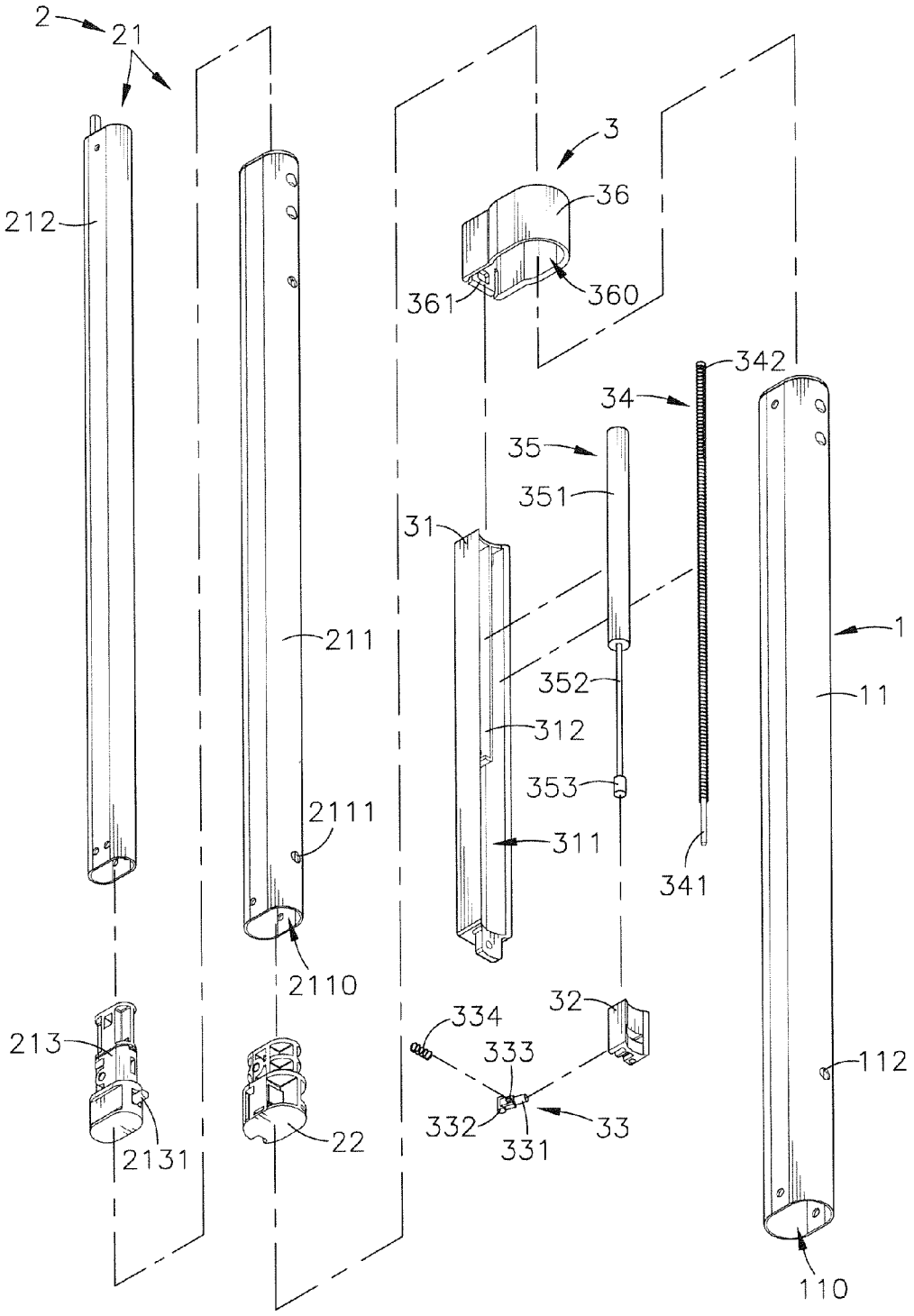
FIG. 5 corresponds to FIG. 4 when viewed from another angle.
Figure 6:
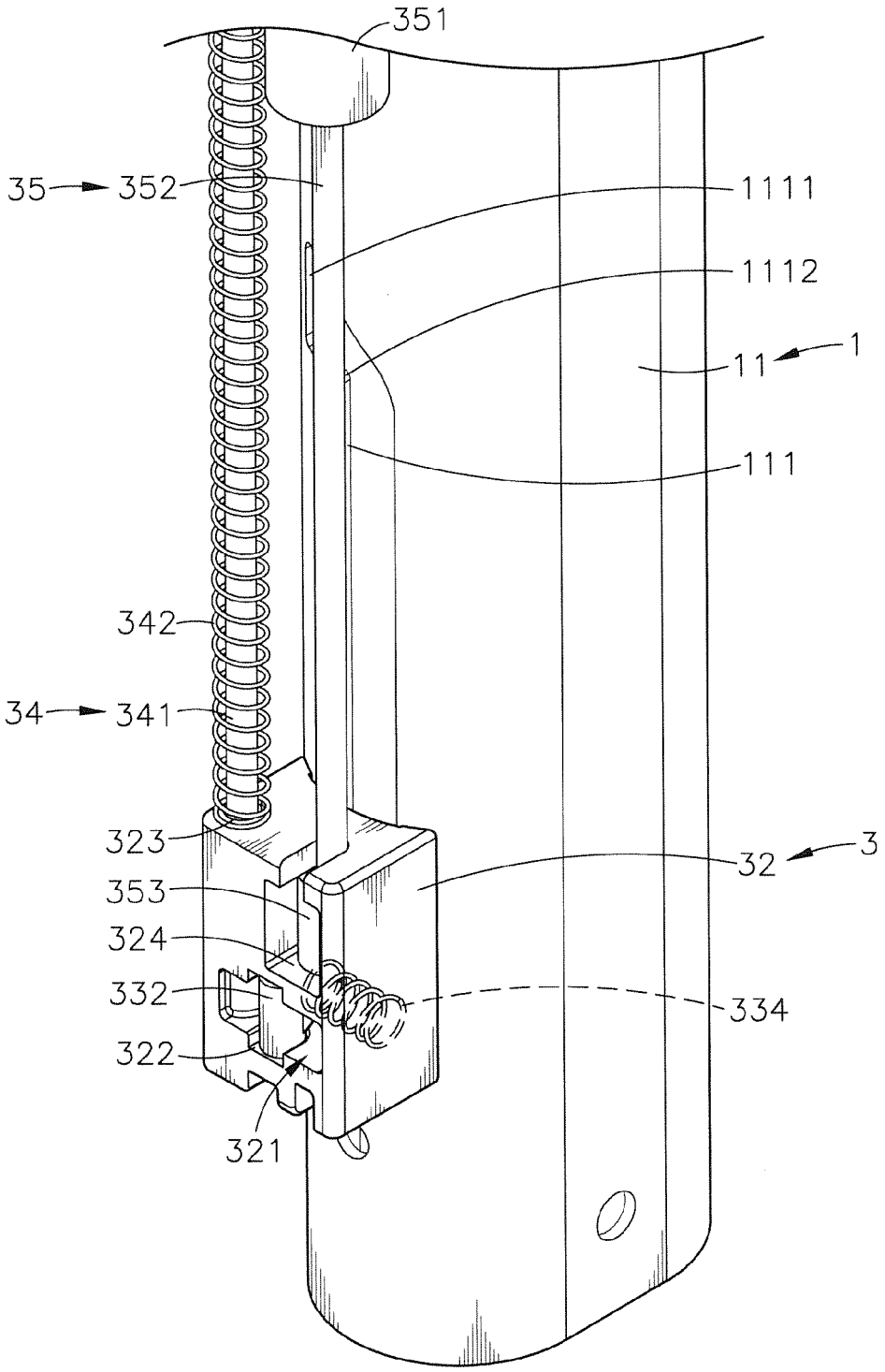
FIG. 6 is an oblique elevational view of one sliding block of the pullback and buffer unit of the retractable luggage handle assembly in accordance with the present invention.

Referring to FIGS. 1-6, a retractable luggage handle assembly in accordance with the present invention is shown. The retractable luggage handle assembly comprises a base unit 1, a retractable handle 2, and a pullback and buffer unit 3.

The base unit 1 comprises two outer sleeves 11 arranged in parallel. Each outer sleeve 11 comprises an axial receiving hole 110 axially extending through opposing top and bottom ends thereof, a first sliding slot 111 longitudinally cut through the periphery thereof and disposed in communication with the axial receiving hole 110 near the bottom end thereof, a first locating hole 1111 perpendicularly extended from a top end of the first sliding slot 111 and defining a first arched edge 1112, a first retaining hole 112 located in the periphery near the bottom end and disposed in communication with the axial receiving hole 110, and a second retaining hole 113 located in the periphery near the top end and disposed in communication with the axial receiving hole 110.

The retractable handle 2 comprises two retractable bars 21, two actuation members 22 respectively mounted at respective bottom ends of the retractable bars 21, and a grip 23 connected between opposing top ends of the retractable bars 21. Each retractable bar 21 comprises an outer tube 211, an inner tube 212 inserted into the associating outer tube 211 and movable relative to the associating outer tube 211 between an extended position and a received position, and a positioning member 213 affixed to a bottom end of the inner tube 212 and inserted with the inner tube 212 into the outer tube 211. The outer tube 211 of each retractable bar 21 comprises an axial passage hole 2110 axially extending through opposing top and bottom ends thereof, and two positioning holes 2111 located in the periphery thereof and respectively disposed near the opposing top and bottom ends in communication with the axial passage hole 2110. The positioning member 213 of each retractable bar 21 comprises a first spring-loaded engaging member 2131 selectively and disengageably engaged into one of the two positioning holes 2111 of the associating outer tube 211 to lock the inner tube 212 to the associating outer tube 211 in the extended or received position. The two actuation members 22 are respectively mounted at the bottom ends of the outer tubes 211 of the retractable bars 21. Each actuation member 22 comprises a second sliding slot 221 longitudinally cut through the periphery thereof, a second locating hole 2211 perpendicularly extended from a top end of the second sliding slot 221 and defining a second arched edge 2212, and a second spring-loaded engaging member 222 extending out of the periphery opposite to the second sliding slot 221. The grip 23 is connected between the top ends of the inner tubes 212 of the retractable bars 21, comprising a control button 231 for moving the first spring-loaded engaging members 2131 and the second spring-loaded engaging members 222 between an engaged position and a disengaged position.

The pullback and buffer unit 3 comprises two rails 31, two sliding blocks 32, two movable member sets 33, two spring-loaded guide members 34, two buffers 35, and two locating caps 36. The two rails 31 are respectively longitudinally attached to the outer sleeves 11 in a parallel manner, each comprising a longitudinal sliding groove 311 and a longitudinal positioning groove 312 longitudinally aligned in line. The sliding blocks 32 are respectively slidably mounted in the longitudinal sliding grooves 311 of the rails 31, each comprising a retaining open chamber 321 transversely disposed near a bottom side thereof, two position-limit grooves 322 respectively located in opposing top and bottom sides in the retaining open chamber 321, a position-limit passage 323 vertically upwardly extended from the retaining open chamber 321 to a top wall thereof, and a locating hole 324 disposed above the retaining open chamber 321. The two movable member sets 33 are respectively mounted in the retaining open chambers 321 of the sliding blocks 32, each comprising an engagement rod 331, a stop block 332 located at one end of the engagement rod 331 and positioned in the position-limit grooves 322 of the associating sliding block 32, a protruding block 333 extended from one lateral side of the engagement rod 331 and suspending in the retaining open chamber 321 of the associating sliding block 32, and an elastic member 334 mounted on the protruding block 333 and stopped against an inside wall of the retaining open chamber 321 of the associating sliding block 32. The two spring-loaded guide members 34 are respectively mounted in the longitudinal sliding grooves 311 of the rails 31, each comprising a guide rod 341 respectively mounted in the position-limit passages 323 of the sliding blocks 32 and a spring member 342 mounted around the guide rod 341. The two buffers 35 each comprise a cylinder 351 filled with a hydraulic fluid and respectively mounted in the longitudinal positioning grooves 312 of the rails 31, a plunger 352 movable in and out of the cylinder 351 and insertable into the longitudinal sliding groove 311 of the associating rail 31, and a locating block 353 located at a distal end of the plunger 352 outside the cylinder 351 and fastened to the locating hole 324 of one respective sliding block 32. The two locating caps 36 are respectively mounted around the outer sleeves 11 of the base unit 1 and capped on the top ends of the rails 31, each comprising a coupling hole 360 cut through opposing top and bottom sides thereof and respectively coupled to the outer sleeves 11 of the base unit 1 and a bottom mounting hole 361 respectively fastened to the top ends of the rails 31.

When installing the retractable luggage handle assembly, affix the bottom ends of the two outer sleeves 11 of the base unit 1 to a bottom mounting frame 4, and then respectively insert the two actuation members 22 of the retractable handle 2 with the respective retractable bars 21 into the axial receiving holes 110 of the two outer sleeves 11 of the base unit 1 to let the second spring-loaded engaging members 222 of the two actuation members 22 of the retractable handle 2 be stopped at the inside walls of the two outer sleeves 11 of the base unit 1 and the first spring-loaded engaging members 2131 of the positioning members 213 of the retractable bars 21 of the retractable handle 2 extend out of the positioning holes 2111 of the outer tubes 211 of the respective retractable bars 21 and the first retaining holes 112 of the respective outer sleeves 11 of the base unit 1. At this time, the first sliding slots 111 of the outer sleeves 11 of the base unit 1 are respectively disposed in communication with the second locating holes 2211 of the actuation members 22 of the retractable handle 2. Thereafter, attach the two rails 31 of the pullback and buffer unit 3 to the outer sleeves 11 to let the engagement rods 331 of the movable member sets 33 in the retaining open chambers 321 of the associating sliding blocks 32 be inserted into the first sliding slots 111 of the outer sleeves 11 of the base unit 1 and the second locating holes 2211 of the actuation members 22 of the retractable handle 2, and then couple the coupling holes 360 of the two locating caps 36 of the pullback and buffer unit 3 to the outer sleeves 11 of the base unit 1 and fasten the bottom mounting holes 361 of the two locating caps 3 to the top ends of the respective rails 31, and then attach a top mounting frame 5 to the opposing top ends of the outer sleeves 11 of the base unit 1, and then fasten the grip 23 to the top ends of the inner tubes 212 of the retractable bars 21 to let the grip 23 be received in a receiving open chamber 51 in the top mounting frame 5.

Alter installation, the first sliding slots 111 of the outer sleeves 11 of the base unit 1 are respectively disposed in communication with the second locating holes 2211 of the actuation members 22 of the retractable handle 2. Further, as described above, the first locating hole 1111 of each outer sleeve 11 extends perpendicularly from the top end of the first sliding slot 11 of the respective outer sleeve 11 and defines a first arched edge 1112, the second locating hole 2211 of each actuation member 22 extends perpendicularly from the top end of the second sliding slot 2211 of the respective actuation member 22 and defines a second arched edge 2212.

Figure 7:
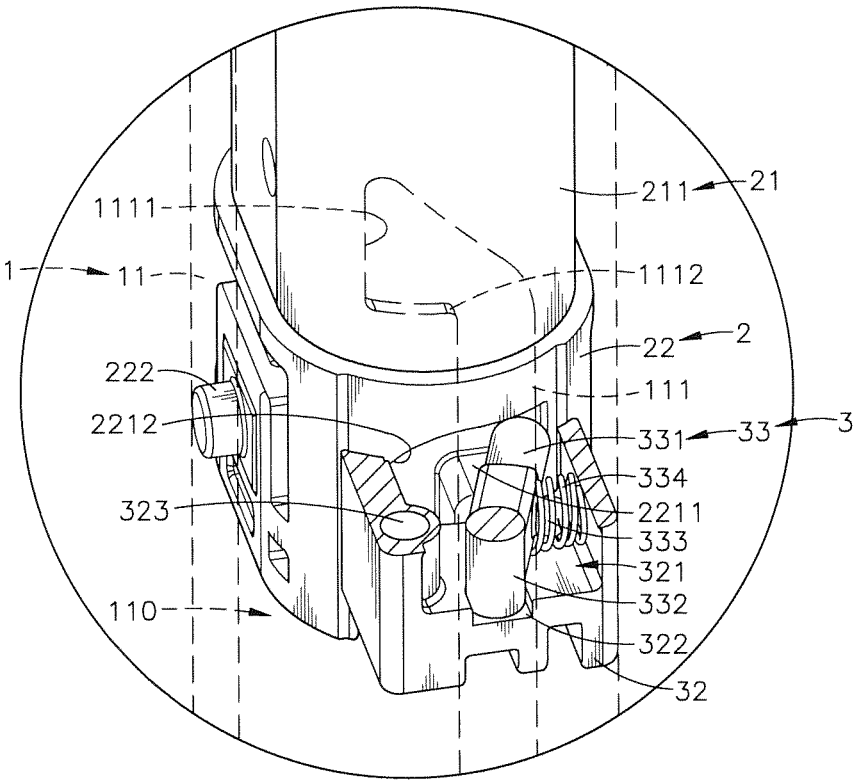
FIG. 7 is a schematic sectional operational view of a part of the retractable luggage handle assembly in accordance with the present invention (I).
Figure 8:
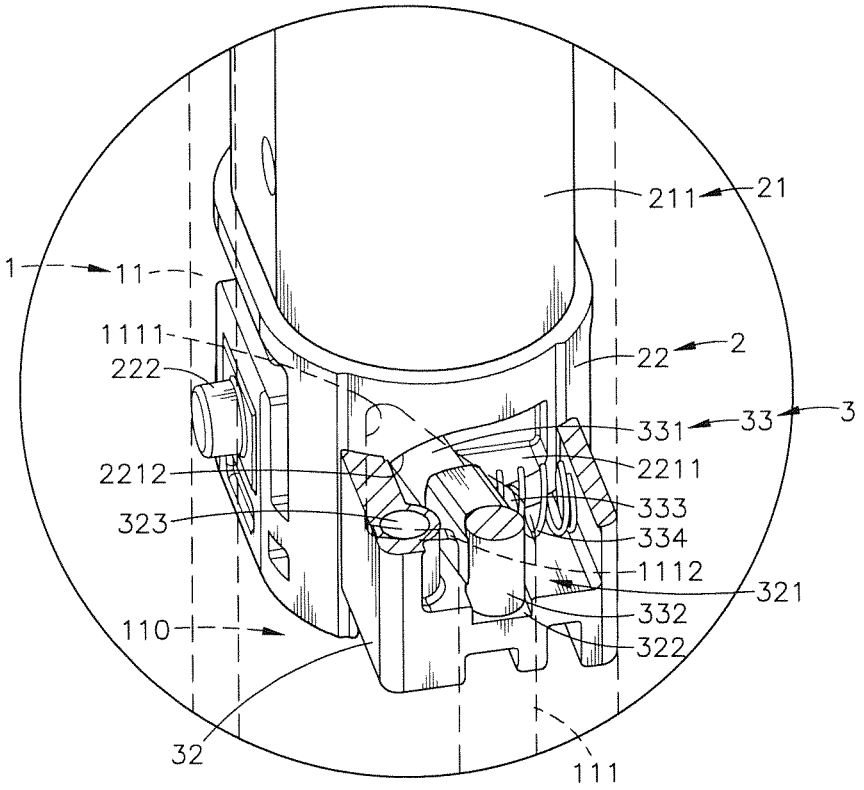
FIG. 8 is a schematic sectional operational view of a part of the retractable luggage handle assembly in accordance with the present invention (II).
Figure 9:
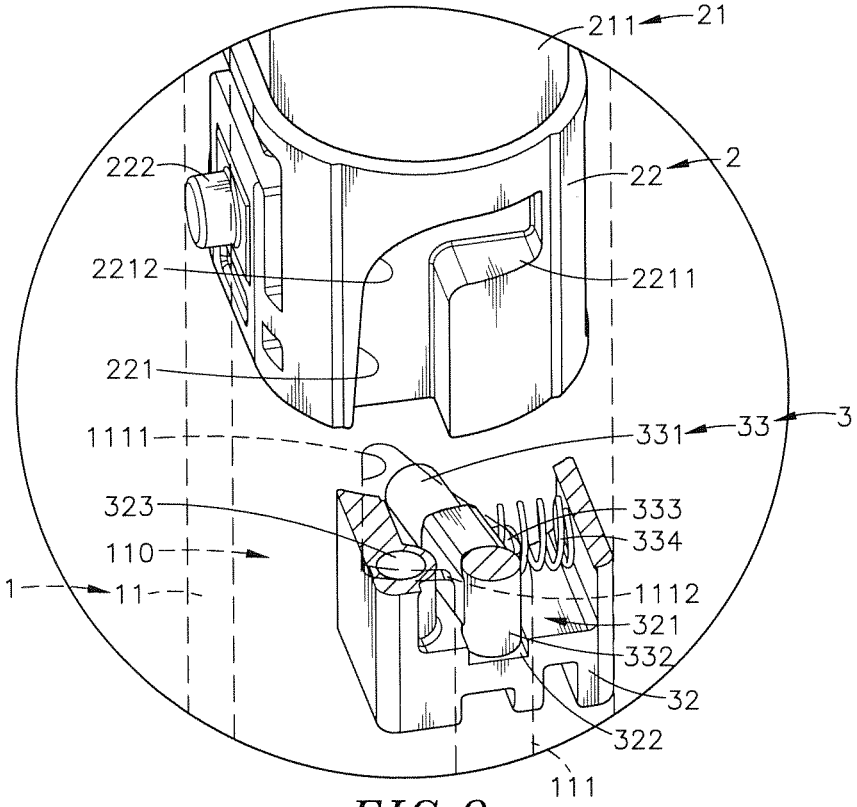
FIG. 9 is a schematic sectional operational view of a part of the retractable luggage handle assembly in accordance with the present invention (III).
Figure 10:
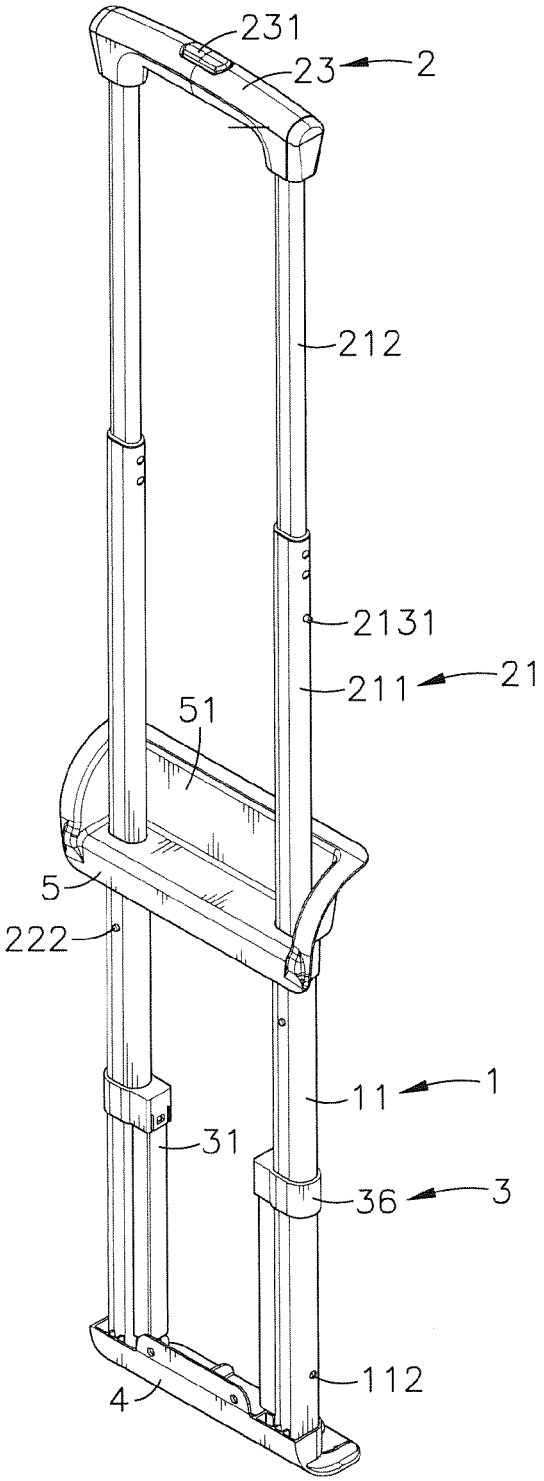
FIG. 10 is an oblique top elevational view of the present invention, illustrating the retractable luggage handle assembly in the extended condition.

Referring to FIGS. 7-10, when the user presses the control button 231 of the grip 23, the first spring-loaded engaging members 2131 of the positioning members 213 of the retractable bars 21 of the retractable handle 2 are retracted away from the positioning holes 2111 of the outer tubes 211 of the respective retractable bars 21 and the first retaining holes 112 of the respective outer sleeves 11 of the base unit 1, and the second spring-loaded engaging members 222 of the two actuation members 22 of the retractable handle 2 are retracted away from the inside walls of the two outer sleeves 11 of the base unit 1. At this time, the user can operate the grip 23 of the retractable bars 21 to pull the inner tubes 212 upwardly out of the axial passage holes 2110 of the respective outer tubes 211 and then to pull the outer tubes 211 upwardly out of the axial receiving holes 110 of the respective outer sleeves 11 of the base unit 1. During upward movement of the outer tubes 211, the engagement rods 331 of the movable member sets 33 are moved with the second locating holes 2211 of the actuation members 22 upwardly along the first sliding slots 111 of the respective outer sleeves 11 of the base unit 1 to compress the spring members 342 of the spring-loaded guide members 34 and the plungers 352 of the buffers 35. Thus, when the engagement rods 331 of the movable member sets 33 are moved to the first arched edges 1112 of the respective outer sleeves 11 of the base unit 1, the engagement rods 331 of the movable member sets 33 will be forced by the respective elastic members 334 to move along the respective first arched edges 1112 into the respective first locating holes 1111 and also to move from the second locating holes 2211 of the actuation members 22 along the second arched edges 2212 to the respective second sliding slots 221. When the actuation members 22 are moved continuously upwards, the engagement rods 331 of the movable member sets 33 will be disengaged from the respective second sliding slots 221 and forced into the respective first locating holes 1111, causing the first spring-loaded engaging members 2131 of the positioning members 213 of the retractable bars 21 and the second spring-loaded engaging members 222 of the two actuation members 22 to be respectively lifted and engaged into the positioning holes 2111 of the respective outer tubes 211 and the second retaining holes 113 of the respective outer sleeves 11, and thus, the retractable handle 2 is locked in the extended position.

When intending to receive the retractable bars 21 of the retractable handle 2, press the control button 231 of the grip 23 to retract the first spring-loaded engaging members 2131 of the positioning members 213 of the retractable bars 21 of the retractable handle 2 away from the positioning holes 2111 of the outer tubes 211 of the respective retractable bars 21 and the first retaining holes 112 of the respective outer sleeves 11 of the base unit 1, and also to retract the second spring-loaded engaging members 222 of the two actuation members 22 of the retractable handle 2 away from the inside walls of the two outer sleeves 11 of the base unit 1, and then push the grip 23 to move the inner tubes 212 of the retractable bars 21 downwardly into the axial passage holes 2110 of the respective outer tubes 211, and thus, the first spring-loaded engaging members 2131 of the positioning members 213 of the retractable bars 21 of the retractable handle 2 are lowered and engaged into the positioning holes 2111 of the outer tubes 211 of the respective retractable bars 21, and the outer tubes 211 are then moved downwardly into the axial receiving holes 110 of the respective outer sleeves 11 of the base unit 1. During downward movement of the outer tubes 211, the engagement rods 331 of the movable member sets 33 are moved out of the first locating holes 1111 into the second sliding slots 221 of the actuation members 22, and the engagement rods 331 of the movable member sets 33 are moved to the second arched edges 2212 and then guided by the second arched edges 2212 to the second locating holes 2211 of the actuation members 22 and also guided by the first arched edges 1112 of the respective outer sleeves 11 of the base unit 1 to the first sliding slots 111. At this time, the spring members 342 of the spring-loaded guide members 34 push the respective sliding blocks 32 downwards, forcing the engagement rods 331 of the movable member sets 33 to move the actuation members 22 downwards, and thus, the second spring-loaded engaging members 222 of the two actuation members 22 of the retractable handle 2 are lowered and engaged into the first retaining holes 112 near the bottom sides of the outer sleeves 11 of the base unit 1, and the plungers 352 of the buffers 35 are lowered to smoothen the downward movement of the actuation members 22, and thus, the retractable handle 2 is locked in the received position.

By means of the spring members 342 in the longitudinal sliding grooves 311 of the rails 31 to push the respective sliding blocks 32 downwardly in forcing the engagement rods 331 of the movable member sets 33 to move the actuation members 22 downwards, the retractable bars 21 can be automatically pushed back into the outer sleeves 11 without any extra pressing operation. Further, during downward movement of the sliding blocks 32, the plungers 352 of the buffers 35 are lowered and received in the cylinders 351 to smoothen the downward movement of the actuation members 22, prohibiting the retractable bars 21 from striking the bottom mounting frame 4 to make noise and preventing component part damage. Thus, the lifespan of the luggage can be prolonged.

In conclusion, the invention provides a retractable luggage handle assembly that comprises a base unit 1 consisting of two outer sleeves 11, a retractable handle 2 consisting of two retractable bars 21, two actuation members 22 and a grip 23 and mounted in the base unit 1 and movable relative to the base unit 1 between an extended position and a received position, and a pullback and buffer unit 3 consisting of two rails 31, two sliding blocks 32, two movable member sets 33, two spring-loaded guide members 34, two buffers 35, and two locating caps 36 and adapted for pulling the retractable bars 21 back to the inside of the outer sleeves 11 of the base unit 1 and moving the buffers 35 to buffer the movement of the sliding blocks 32 when the user operates a control button 231 at the grip to receive the retractable handle 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A retractable luggage handle assembly, comprising:

a base unit comprising two outer sleeves arranged in parallel, each said outer sleeve comprising an axial receiving hole axially extending through opposing top and bottom ends thereof, a first sliding slot longitudinally cut through the periphery thereof and disposed in communication with said axial receiving hole, and a first locating hole perpendicularly extended from a top end of said first sliding slot and defining a first arched edge;

a retractable handle mounted in said base unit and controllable to move between an extended position and a received position with respect to said base unit, said retractable handle comprising two retractable bars, two actuation members respectively mounted at respective bottom ends of said retractable bars, and a grip connected between opposing top ends of said retractable bars, each said actuation member comprising a second sliding slot longitudinally cut through the periphery thereof and a second locating hole perpendicularly extended from a top end of said second sliding slot and defining a second arched edge; and a pullback and buffer unit having two sliding blocks, adapted for respectively pulling said retractable bars back to the inside of said outer sleeves of said base unit and buffering the movement of said sliding blocks when a person operates a control button of said grip and move said grip to receive said retractable handle from said extended position to said received position, said pullback and buffer unit comprising two rails respectively attached to said outer sleeves of said base unit, two sliding blocks, each said rail comprising a longitudinal sliding groove and a longitudinal positioning groove, said two sliding blocks respectively slidably mounted in said longitudinal sliding grooves of said rails, each said sliding block comprising a retaining open chamber transversely disposed near a bottom side thereof, two movable member sets respectively mounted in said retaining open chambers of said sliding blocks, each said movable member set comprising an engagement rod insertable into the first sliding slot of one respective said outer sleeve and the second locating hole of one respective said actuation member and an elastic member stopped against an inside wall of the retaining open chamber of the associating said sliding block, two spring-loaded guide members respectively mounted in said longitudinal sliding grooves of said rails and two buffers respectively mounted in said longitudinal positioning grooves of said rails and adapted for buffering the movement of said sliding blocks.

2. The retractable luggage handle assembly as claimed in claim 1, wherein each said retractable bar comprises an outer tube, an inner tube movable in and out of said outer tube, and a positioning member affixed to a bottom end of said inner tube and inserted with said inner tube into said outer tube; said grip is connected between opposing top ends of said inner tubes of said retractable bars.

3. The retractable luggage handle assembly as claimed in claim 2, wherein said outer tube of each said retractable bar comprises an axial passage hole axially extending through opposing top and bottom ends thereof, and two positioning holes respectively transversely disposed near opposing top and bottom ends in communication with said axial passage hole; the positioning member of each said retractable bar comprises a first spring-loaded engaging member selectively and disengageably engaged into one of the two positioning holes of the associating said outer tube to lock the respective said inner tube to the associating said outer tube in said extended position or said received position; said two actuation members are respectively mounted at the bottom ends of said outer tubes of said retractable bars; each said actuation member further comprises a second spring-loaded engaging member extending out of the periphery opposite to said second sliding slot and stopped against an inside wall of one respective said outer sleeve; said grip comprises a control button operable to move said first spring-loaded engaging members and said second spring-loaded engaging members.

4. The retractable luggage handle assembly as claimed in claim 1, wherein each said sliding block further comprises a position-limit passage vertically upwardly extended from said retaining open chamber to a top wall thereof; each said spring-loaded guide member comprises a guide rod mounted in the position-limit passage of one said sliding block, and a spring member mounted around said guide rod and stopped against one said sliding block.

5. The retractable luggage handle assembly as claimed in claim 1, wherein each said sliding block further comprises a locating hole disposed above the retaining open chamber thereof; each said longitudinal positioning groove longitudinally disposed in alignment with the longitudinal sliding groove thereof; each said buffer comprise a cylinder filled with a hydraulic fluid and mounted in the longitudinal positioning groove of one said rail, a plunger movable in and out of said cylinder and insertable into the longitudinal sliding groove of the associating said rail, and a locating block located at a distal end of said plunger outside said cylinder and fastened to the locating hole of one respective said sliding block.

6. The retractable luggage handle assembly as claimed in claim 1, wherein said pullback and buffer unit further comprises two locating caps respectively mounted around said outer sleeves of said base unit and capped on respective top ends of said rails, each said locating cap comprising a coupling hole cut through opposing top and bottom sides thereof and coupled to the associating said outer sleeve of said base unit and a bottom mounting hole fastened to the top end of one respective said rail.

7. The retractable luggage handle assembly as claimed in claim 1, wherein each said sliding block further comprises two position-limit grooves respectively located in opposing top and bottom sides in the retaining open chamber thereof; each said sliding block further comprises a stop block located at one end of the engagement rod thereof and positioned in the position-limit grooves of the associating said sliding block, a protruding block extended from one lateral side of the engagement rod thereof and suspending in said retaining open chamber of the associating said sliding block, and said elastic member mounted on said protruding block and stopped against an inside wall of the retaining open chamber of the associating said sliding block.

* * * * *